United States Patent [19]

Polk

[11] Patent Number: 4,659,110

[45] Date of Patent: Apr. 21, 1987

[54] MANUAL SHEET SEPARATION SYSTEM

[76] Inventor: William E. Polk, 2721 St. Mary's St., Raleigh, N.C. 27609-7640

[21] Appl. No.: 739,895

[22] Filed: May 31, 1985

[51] Int. Cl.[4] ..... B42F 21/00; B42F 21/12

[52] U.S. Cl. ..... 283/36; 283/42

[58] Field of Search ..... 283/36, 37, 38, 41, 283/42, 40; 209/608; 281/40, 41; 282/28 A

[56] References Cited

U.S. PATENT DOCUMENTS

| | | | |
|---|---|---|---|
| Re. 17,486 | 11/1929 | Luginbuhl | 283/36 |
| 1,150,793 | 8/1915 | Tallmadge | 209/608 |
| 1,659,067 | 2/1928 | Adams | 283/36 |
| 1,931,168 | 10/1933 | Scott | 282/28 A |
| 2,272,858 | 2/1942 | Werkheiser | 281/38 |
| 2,398,294 | 4/1946 | Embertson | 283/42 |
| 4,523,775 | 6/1985 | Reist | 283/36 |

FOREIGN PATENT DOCUMENTS

| | | | |
|---|---|---|---|
| 0383582 | 11/1932 | United Kingdom | 283/42 |

*Primary Examiner*—Howard N. Goldberg
*Assistant Examiner*—Taylor J. Ross

[57] ABSTRACT

This invention is for a publication, loose leaf card file or the like, embodying an improved manual sheet separation format, wherein each aligned single sheet of the stack of flexible sheets has a notch (for thumb insertion) in a free edge of said sheet, the notch centers of adjacent sheets being displaced from each other so that an area of each sheet's individual notch superimposes (and exposes) a portion of the adjacent sheet's face edge; one improvement being the placement of an identification notch marker on each sheet's face edge adjacent to the rim of said notch at an area where each stacked sheet's face edge overlies (and conceals from view) the marker on the underlying adjacent sheet; another improvement being the provision of a recessed thumb pivot area along a common side of said stacked sheets, the pivot area being the area of partial overlap of notches in the free edges of the uppermost adjacent stacked sheets; the pivot area serving as an efficient location for one to grip the stacked sheets and apply thumb pressure to the thumb pivot area, while applying opposing finger pressure to a rearward sheet, the thumb then being rocked back and forth for consecutive sheet flexing and separation.

9 Claims, 10 Drawing Figures

FIG.5
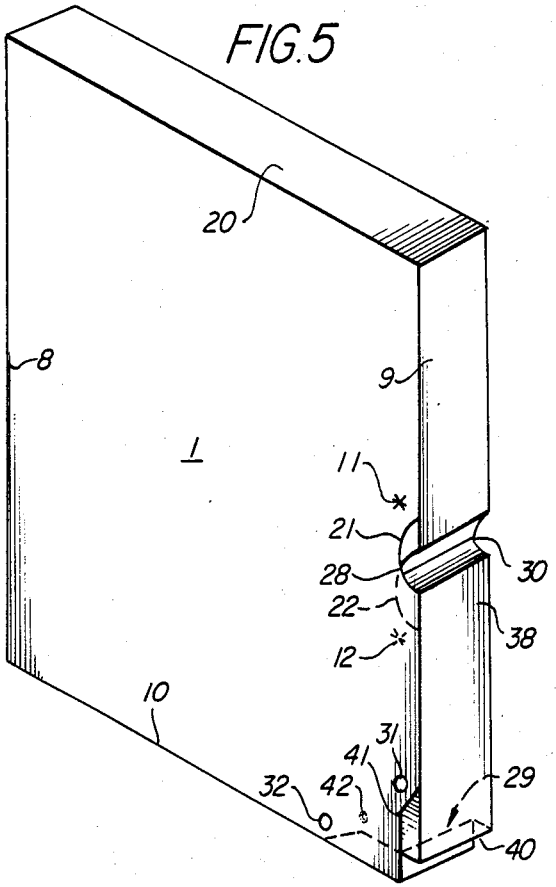
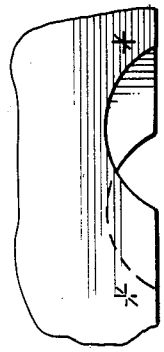
FIG.6
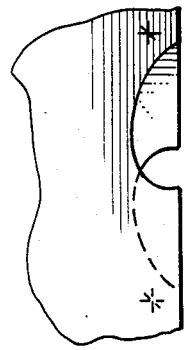
FIG.7
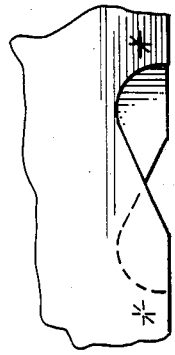
FIG.8
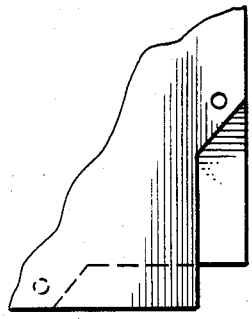
FIG.9
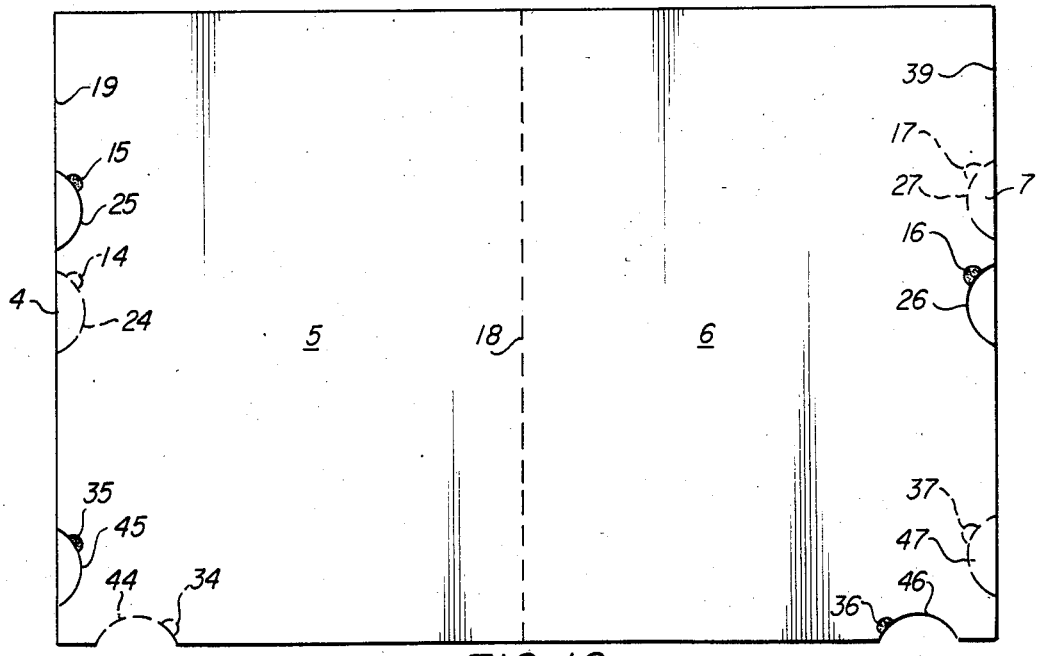
FIG. 10

MANUAL SHEET SEPARATION SYSTEM

BACKGROUND OF THE INVENTION

The present invention relates to manual sheet separation systems of the type which use notches in the sheets' edges to facilitate the consecutive separation and turning of the sheets of a publication, card file, loose leaf stack and similar items consisting of three or more stacked flexible sheets, hereafter referred to as a 'stack of sheets'.

Prior art relating to methods of sheet separation discloses the use by Adams of notches cut in the sheets' edges along a common side of each sheet, therebeing a complete off-set between notches of adjacent sheets, so that a person either moves their thumb laterally back and forth between notches for sheet separation or alternately uses a thumb and finger on adjacent notches.

Prior art also discloses the use by Kitcat of notch markers consisting of inked divider lines drawn across the front edges of a stack of sheets to separate the rows of notches along the front edges of the publication, these divider lines are difficult to see when only a few sheets are stacked together.

Other known methods of notch marking use markers adjacent to the sheets' edges at points where the mark is under the notched-out area of the sheet that overlays it. This method permits markers on adjacent sheets to be seen at the same time, and is not suitable for consecutive sheet separation purposes.

SUMMARY OF THE INVENTION

This invention presents methods and construction techniques for accomplishing the following objects:

An object of this invention is to provide an improved manual sheet separation system that is specifically adapted to give more ease and efficiency in the operation of separating several flexible sheets of a stack of sheets in consecutive order by providing an identation type thumb pivotal area between adjacent notches along a common side of said stack of sheets.

Another object is to provide a means to overcome the difficulty of visually spotting the specific notched-out thumb placement area of an exposed sheet when the notch overlays an adjacent sheet of the same color.

A further object is to provide better methods of applying the notch markers on the sheets.

An additional object is to bring forth a new article of manufacture or improvement thereof that stimulates trade, the article comprising stack portions of prefabricated sheets for the printing trade that contain the improvements of this invention.

My invention presents a more efficient means of consecutive sheet separation through the use of a common area of notch overlap between adjacent sheets as a thumb pivot area on which the thumb may be rocked back and forth between notches of adjacent sheets. My invention presents improved methods to highlight the individual notch location on adjacent sheets.

This invention is applicable to a book or similar items having three or more single sheets stacked together so that the sheets may be pivoted along one edge of the stack and be free to be turned at the other edge. It is also applicable to publications which contain folded sheets similar to many newspapers with the pivotal edges being at the sheets' fold lines, in which case one folded sheet is hereafter treated as being two single sheets. Each single sheet has a front side and a back side, there being no reference to page numbers in the following description. This invention comprises the use of one notched-out area in one of said free edges of each single sheet of a stack of sheets. On alternate sheets of each stack the notch centers are located along the sheets' free edges at a preselected uniform distance and direction from the notch centers of their adjacent sheets. This arrangement of displaced notches in the free edges of adjacent sheets permits a person to separate an exposed sheet from an adjacent sheet by applying thumb pressure within the notched-out area of the exposed sheet of the stack that is to be separated and at the same time applying flexing pressure to the back side of a rearward sheet with the fingers of the same hand. For consecutive separation of the next exposed sheet the thumb pressure is applied within the newly exposed sheet's notched-out area to assist the fingers in flexing the sheets for the separation of said newly exposed sheet. The foregoing procedure is repeated when consecutive sheet separation is desired. If need be the opposite hand may be used to complete the turning of the sheet after it has been separated from the adjacent sheet.

As an aid to the placement of one's thumb during consecutive sheet separation, this invention includes placement and methods of application of an identification marker of suitable color adjacent to the rim of each notched-out area, the marker being visible when viewed from a vertical position above the exposed sheet's notch rim and/or identation rim, but not visible on the other sheets until they are turned to their exposed position. Some methods of marking the notched-out areas are:

1. An asterik or other character is printed adjacent to the notch rim on each side of the sheet at a point where it is concealed from view except when the sheet becomes exposed. The printing of the markers may be done along with the general printing-typesetting routine for the document.

2A. A stripe of absorbent permanent ink is applied across the inner edges of the notched-out area while the notches of a stack portion are in alignment and the sheets are pressed firmly together, thus producing a marker that is visible from either side of the sheet when viewed from a vertical position above the sheet.

2B. Before applying the stripe of absorbent ink as in method 2A above, fan out the sheets' edges so that the free edge of each sheet projects slightly to the right of the sheet that overlays it. The sheets' edges are caused to fan out by binding the pivotal edges of the stack portion together and then fold or roll the stack portion until the free edges of each sheet projects a little beyond the edge of the sheet above it. A stripe of absorbent ink is then applied across the inner notch edges. After the fluid has dried the stack portion is unrolled and the sheets are ready for use, the marker being visible from either side of each sheet when viewed from a vertical position above the sheet, the markers being of a more uniform size with this method than for method 2A. Marker stripes may be multi-colored as in a rainbow to contrast with variable sheet colors.

3. A small hole approximately $\frac{1}{8}$ inch in diameter is punched or drilled through the stack portion at a sutitable point near the sheets' edges adjacent to the notches. These holes become visible when flexing pressure of the thumb is applied to the sheets' edges nearby. This type marker is useful in conjunction with the indentation marker of method 4 below.

4. Where adjacent sheets of a stack have notches that overlap, there is a notch type indentation defined between said sheets that serves as a marker for thumb placement, the exposed face edges adjacent to the inner rim of said indentation area being a 'stack indentation type' notch marker that is visible along the notch contour when viewed from above the stacked sheets.

This invention presents a method of construction that is designed to contribute to the efficiency of consecutive sheet separation systems, the construction being the partial overlapping of the notches of adjacent sheets by a preselected amount to give a suitable indentation along the sheets' free edges, said indentation being the result of the partial overlap of adjacent notches, this area of indentation is between adjacent sheets and also between all sheets of the stack, and it provides a notch-type indentation that is visible along the sheets' free edges, thus serving as a marker for proper thumb placement. A unique advantage provided by this indentation is that it causes the cross-over point between overlapped notches to be away from the sheets' free edges, thus providing an effective pivot area for one's thumb to be rocked back and forth between notches of adjacent sheets to apply flexing pressure in coordination with finger pressure on a rearward sheet to separate the sheets in consecutive order, the thumb's pivot area in this case being between the tip of the thumb and the first joint therefrom. The indentation also permits one's thumb and wrist to be held at a comfortable angle of about 45 degrees with the free edge of the sheets.

The use of notch indentation between overlapped notched-out areas is not limited to the free edges of the sheets that are opposite the pivotal edges. The lower and/or upper edges may be used. Also the corners of the sheets' free edges are advantageous spots for placing a notched-out segment on one side of a corner of alternate sheets, and on the other side of the same corner on sheets spaced between said alternate sheets, so that the adjacent notched-out segments are at right angles to each other and they partially overlap, thus forming an indentation type notch at the corner.

Adjustments to the length, width, position and configuration of the notches and indentations are made in the design stage to give best results for the particular sheet characteristics of thickness, flexibility and size.

BRIEF DESCRIPTION OF THE DRAWINGS

FIG. 5 is a perspective view of the assembled document of FIG. 4 in its closed position.

FIGS. 6, 7, 8 and 9 are full scale detail views looking downward on the notched-out areas showing the partial overlap and indentation areas of the notches on adjacent sheets.

FIG. 10 is a view looking downward toward the top of a stack of double width sheets prior to being folded.

DESCRIPTION OF THE PREFERRED EMBODIMENTS

Figure 1:
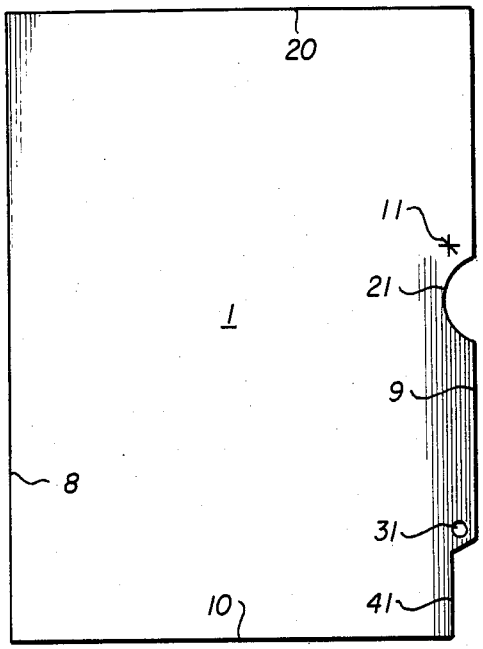
FIGS. 1, 2 and 3 are views looking downward toward the top of single flexible sheets.

With reference to the drawings:

FIG. 1 is a top view of sheet 1 showing its pivotal edge 8, free edge 9, bottom edge 10 and top edge 20, there being a notch 21 with printed type marker 11 adjacent thereto in the sheet's free edge near the middle thereof. Notched-out segment 41 at the lower corner extends length-wise along free edge 9, with a punched hole type marker 31 adjacent thereto.

Figure 2:
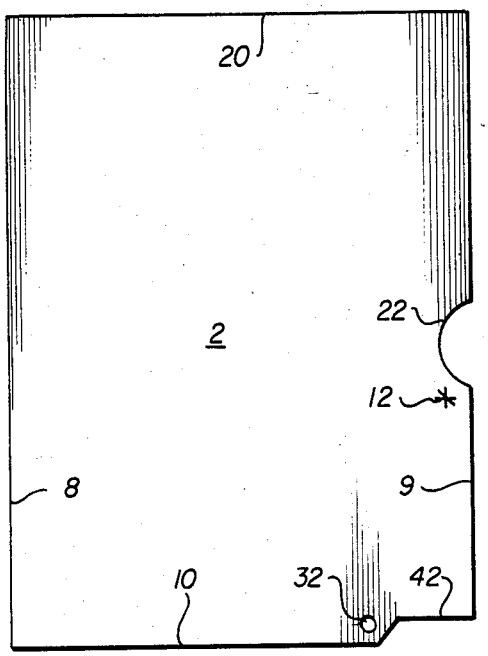

FIG. 2 is a top view of sheet 2 showing notch 22, and printed type marker 12, the center of notch 22 being set at a spot so that notch 22 will partially overlap notch 21 when the sheets are stacked in consecutive order. Notched-out segment 42 extends length-wise along sheet edge 10, with punched hole type marker 32 adjacent thereto. Sheet edges 8, 9, 10 and 20 are typical for all sheets of the stack shown in FIGS. 4 and 5.

Figure 3:
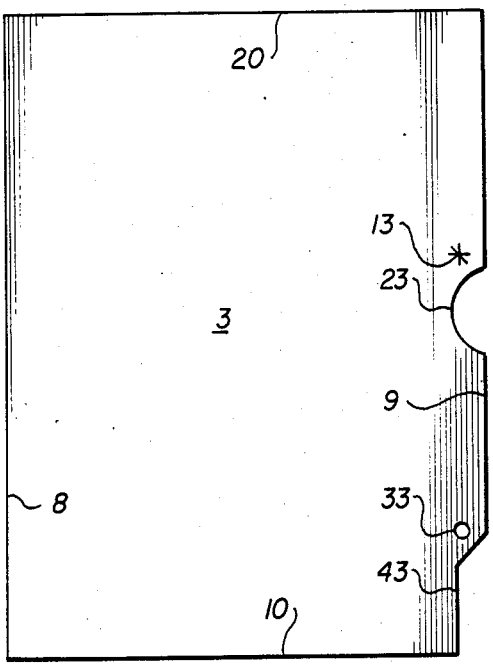

FIG. 3 is a top view of sheet 3 showing notches 23 and 43, and markers 13 and 33, sheet 3 layout being a duplicate of sheet 1.

Figure 4:
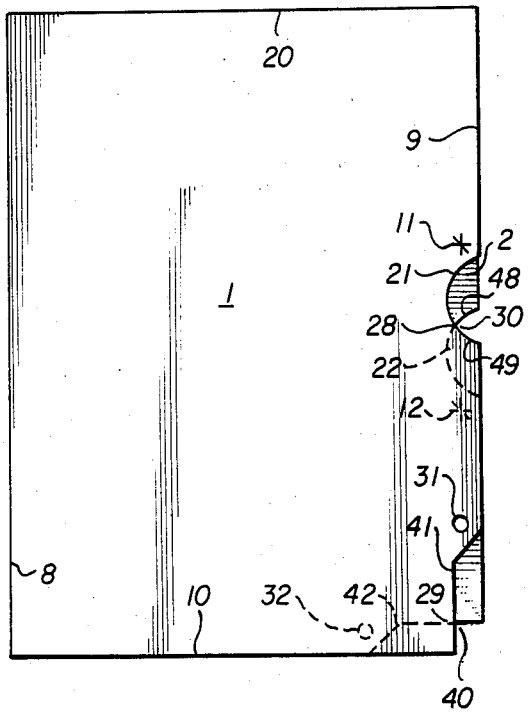
FIG. 4 is a view looking downward toward the top of a stack of single flexible sheets.

FIG. 4 is a top view of a stack of sheets comprising sheet 1 on top, sheet 2 directly below sheet 1, sheet 3 directly below sheet 2, and other sheets stacked to give a uniform partial overlap of notches between adjacent sheets. The cross-over point between notch 21 and 22 is at 28, the indentation area is at 30. The exposed face edges along the inner rims of the indentation type notch between sheets 1 and 2 are at 48 and 49, similar face edges of sheets below sheet 2 being blocked from view. Between notches 41 and 42 the cross-over point is at 29 and the indentation area is at 40.

FIG. 5 is a perspective view of FIG. 4 showing the perimeter of the indentation areas at 30 for the upper notches, and at 40 for the lower notches, and notch crossover lines 28 and 29 extending across the stack's front unbound edges 38.

FIG. 6 is a detail top view showing the overlap of notches between sheets 1 and 2 along the free edge of the sheets' mid-section reference FIG. 4.

FIG. 7 is similar to FIG. 6 except for the notch configuration that provides a smaller indentation area.

FIG. 8 is similar to FIG. 6 except for notch configuration.

FIG. 9 is a detail top view showing the overlap of notches between sheets 1 and 2 at the lower corners of said sheets, reference FIG. 4.

FIG. 10 is a top view of a stack of double width sheets showing fold line 18 at the mid-section of the stack, with designated single sheet 6 on the right of the fold line and single sheet 5 on the left, making up the top double sheet of a stack of double sheets. Single sheets 4 and 7 underlay sheets 5 and 6 respectively, to make the next double sheet. Sheet 5 has a notch 25 that is fully off-set from notch 24 on sheet 4. Also, sheet 5 has a notch segment 45 that is fully displaced from and is at a right angle to notch 44 on sheet 4. On sheet 6 notch 26 is fully off-set from notch 27 on sheet 7, while notch 46 on sheet 6 is fully displaced from and is at a right angle to notch 47 on sheet 7. The locationn of all notches in FIG. 10 is indentified by an absorbent ink marker, the markers being 14, 15, 34, 35, 16, 17, 36, and 37. The sheets' free edges are labeled 19 on the left side and 39 on the right side.

It will be understood that other modifications within the scope of the appended claims may be made in the design and sequence of assembly, without departing from the spirit of this invention.

What I claim is:

1. A pagination system, said system comprising:

a stack of at least three sheets, each of said sheets having front and rear faces, a pivotal edge, and at least one free edge, the pivotal edges of said sheets being substantially aligned;

each of said sheets further having a notch removed therefrom along a common one of said at least one free edge, said notches having a perimeter, a length along said common edge, and a center defined by the mid-point of said length;

the notch centers of alternate ones of said sheets being arranged in a first row aligned substantially transversely of said stack, the notch centers of remaining ones of said sheets being arranged in a second row aligned substantially transversely of said stack and displaced a distance along said common edge relative to said first row; and said distance the notch centers are displaced is less than the length of said notches, such that adjacent notches partially overlap, thereby defining an indentation notch marker.

2. A pagination system, said system comprising:

a stack of at least three sheets, each of said sheets having front and rear faces, a pivotal edge, and at least one free edge, the pivotal edges of said sheets being substantially aligned;

each of said sheets further having a notch removed therefrom along said at least one free edge, said notches having perimeter, a length along said at least one free edge, and a center defined by the mid-point of said length;

the notch centers of alternate ones of said sheets being arranged in a first row aligned substantially transversely of said stack, the notch centers of remaining ones of said sheets being arranged in a second row aligned substantially transversely of said stack and displaced a distance along said at least one free edge relative to said first row; and notch marker means for indicating the position of said notches, said notch marker means being positioned on at least one of said faces of each of said sheets adjacent the perimeter of said notches such that the notch marker means of an underlying sheet is covered and obscured by an overlying sheet, the notch marker means of said alternate sheets and said remaining sheets each being aligned substantially transversely of said stack and spaced relative to each other.

3. The system of claim 1 wherein, said notch marker means is a printed character.

4. The system of claim 1, wherein, said notch marker means is a hole extending through each said sheet.

5. The system of claim 1 wherein, said distance the notch centers are displaced is less than the length of said notches, such that adjacent notches partially overlap, thereby defining an indentation notch marker.

6. The system of claim 1 wherein, said notches being arranged along a common one of said at least one free edge.

7. The system of claim 6 wherein, said distance the notch centers are displaced is less than the length of said notches, such that adjacent notches partially overlap, thereby defining an indentation notch marker.

8. The system of claim 1 wherein, each of said sheets has at least two free edges, said notches of said alternate sheets being arranged along one of said free edges, and said notches of said remaining sheets being arranged along another of said free edges.

9. The system of claim 8, wherein, said one and said other of said at least two free edges are angularly disposed and define a corner, said notches being arranged adjacent to and encompassing said corner, such that adjacent notches partially overlap thereby defining an indentation notch marker.

* * * * *

UNITED STATES PATENT AND TRADEMARK OFFICE

CERTIFICATE OF CORRECTION

PATENT NO. : 4,659,110

DATED : April 21, 1987

INVENTOR(S) : William E. Polk

It is certified that error appears in the above-identified patent and that said Letters Patent is hereby corrected as shown below:

Column 1, line 39 and column 2, line 30,"Identation" each occurrence, should read -- Indentation --. Column 6, lines 5, 7, 10, 15, and 23 reference numeral "1" each occurrence, should read -- Numeral -- 2 --.

Signed and Sealed this

Eighteenth Day of August, 1987

*Attest:*

DONALD J. QUIGG

*Attesting Officer*

*Commissioner of Patents and Trademarks*